US006457889B1

(12) United States Patent
Lin

(10) Patent No.: US 6,457,889 B1
(45) Date of Patent: Oct. 1, 2002

(54) HOT MELT GLUE GUN WITH PREVENTION OF ABNORMAL MELTING OF A GLUE STICK

(76) Inventor: Hwai-Tay Lin, Tortola (VG)

( * ) Notice: Subject to any disclaimer, the term of this patent is extended or adjusted under 35 U.S.C. 154(b) by 0 days.

(21) Appl. No.: 10/006,194

(22) Filed: Dec. 3, 2001

(51) Int. Cl.[7] ..... B43M 1/02
(52) U.S. Cl. ..... 401/2; 222/146.2; 126/401
(58) Field of Search ..... 401/1, 2; 222/113, 222/146.2, 146.3, 146.4, 146.5, 146.1; 126/401; 219/227, 228, 229, 230

(56) References Cited

U.S. PATENT DOCUMENTS 4,314,655 A * 2/1982 Leibhard et al. ..... 222/146
4,358,030 A * 11/1982 Leibhard et al. ..... 222/146
4,804,110 A * 2/1989 Sperry et al. ..... 222/56
5,479,914 A * 1/1996 Tsai ..... 126/401
5,960,996 A * 10/1999 Hsu ..... 222/113

* cited by examiner

*Primary Examiner*—Timothy L. Maust
*Assistant Examiner*—Huyen Le
(74) *Attorney, Agent, or Firm*—Alan Kamrath; Rider, Bennett, Egan & Arundel, LLP

(57) ABSTRACT

A hot melt glue gun including a housing, a heating chamber defined in the housing for heating a solid glue stick to its melting point, a sleeve for holding a portion of the solid glue stick outside the heating chamber, and an insulating member for prohibiting heat transfer from the heating chamber to the sleeve. The insulating member keeps the sleeve at a temperature below the melting point of the solid glue stick, thereby preventing melting of the portion of the solid glue stick outside the heating chamber.

16 Claims, 8 Drawing Sheets

HOT MELT GLUE GUN WITH PREVENTION OF ABNORMAL MELTING OF A GLUE STICK

BACKGROUND OF THE INVENTION

1. Field of the Invention

The present invention relates to a hot melt glue gun with prevention of abnormal melting of a glue stick outside a heating chamber thereof, thereby preventing undesired hardening of the melted glue stick in the solid stick feeding passage and the resultant blockage of the solid stick feeding passage.

2. Description of the Related Art

FIG. 1 of the drawings illustrates a conventional hot melt glue gun comprising a housing 10 having a grip 11. A gas container 12 containing flammable gas is mounted in the grip 11. A combustion chamber 14 is provided in a front portion of the housing 10 and communicated with the gas container 12 via a conduit or gas tube 13. An igniting device 141 is provided to ignite the flammable gas fed into the combustion chamber 14. The heat generated in the combustion chamber 14 is transferred to a heating chamber 17 that is also located in the front portion of the housing 10. The outer wall defining the heating chamber 17 is in direct contact with the outer wall defining the combustion chamber 14 to proceed with heat conduction. A dispensing nozzle 161 is provided at the front end of the housing 10 for dispensing melted glue. A solid glue stick passage is defined in a rear portion of the housing 10 for receiving a solid glue stick 16. A carrier 152 is mounted in the rear portion of the housing 10 and connected to a spring 151 at an end thereof. The carrier 152 comprises a bore that defines a portion of the solid glue stick passage. A sleeve 18 is mounted between the heating chamber 17 and the carrier 152 for holding the solid glue stick 16. When a trigger 15 is pulled, the carrier 152 is actuated to move the solid glue stick 16 into the heating chamber 17. The solid glue stick 16 is melted in the heating chamber 17 and dispensed via the dispensing nozzle 161.

The sleeve 18 is soft and may expand or shrink in diameter in response to a temperature change, thereby accommodating solid glue sticks of various diameters as a result of tolerance. However, the heat from the heating chamber 17 is transferred to the sleeve 18 and thus melts the solid glue stick outside the heating chamber 17 (see bulged portion 162 in FIG. 1). A solid bulged portion 162 is formed after the sleeve 18 is cooled, and the solid glue stick passage is blocked in an end of the sleeve 18. As a result, the solid glue stick 16 cannot be moved, and the user has to remove the solid bulged portion 162 via a fixing hole 19 in the rear portion of the housing 10.

SUMMARY OF THE INVENTION

An object of the present invention is to provide a hot melt glue gun with prevention of abnormal melting of the glue stick outside a heating chamber thereof, thereby preventing undesired hardening of the melted glue stick in the solid stick feeding passage and the resultant blockage of the solid stick feeding passage.

In accordance with the present invention, a hot melt glue gun is provided for receiving a solid glue stick, heating the glue stick to its melting point, and dispensing the melted glue. The hot melt glue gun comprises a housing comprising a grip portion and a dispensing nozzle, a heating chamber defined in the housing for heating a solid glue stick to its melting point, means for heating the heating chamber, means for feeding the solid glue stick into the heating chamber, a sleeve for holding a portion of the solid glue stick outside the heating chamber, and insulating means for prohibiting heat transfer from the heating chamber to the sleeve. The insulating means keeps the sleeve at a temperature below the melting point of the solid glue stick, thereby preventing melting of the portion of the solid glue stick outside the heating chamber.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
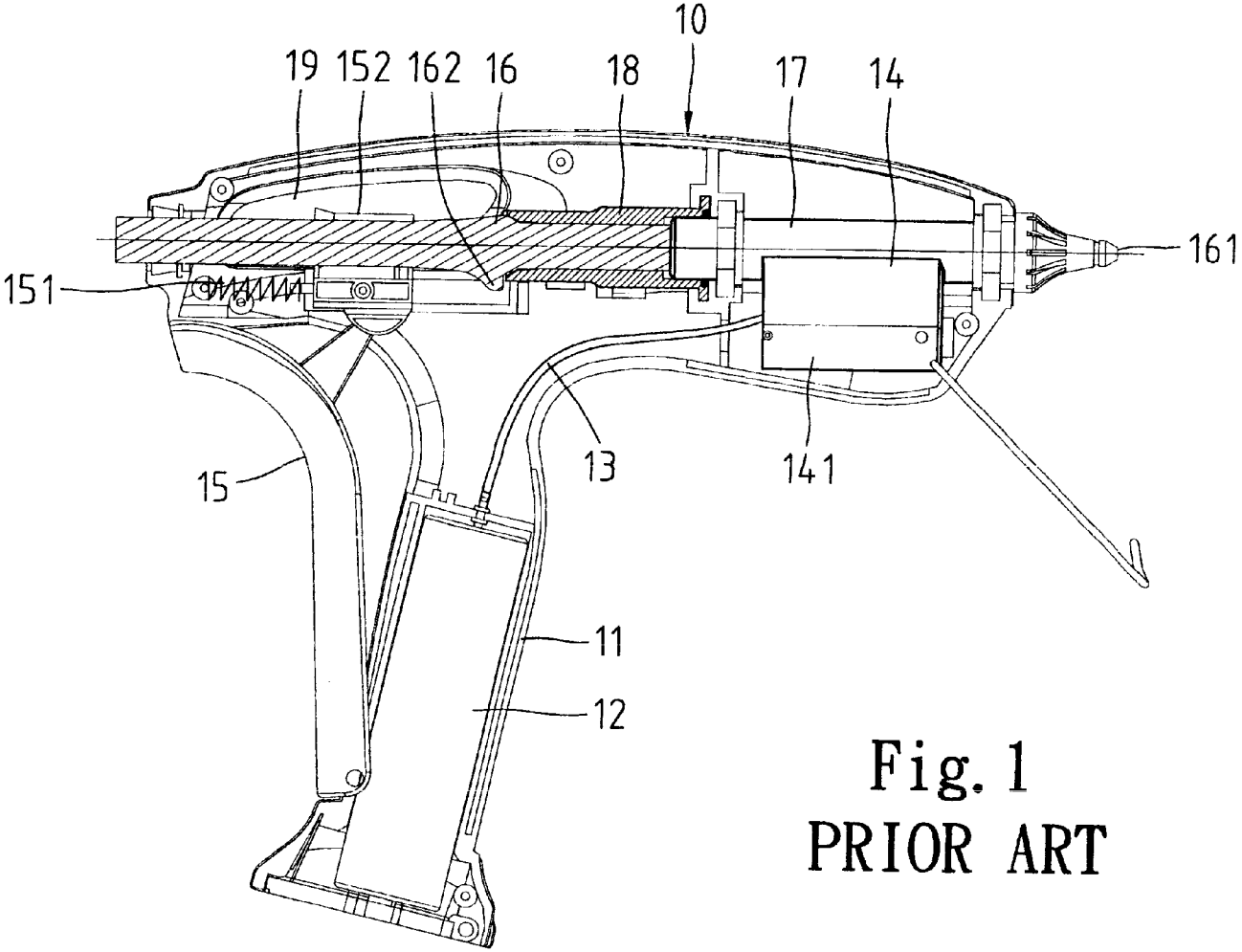
Fig. 1 PRIOR ART
FIG. 1 is a sectional view of a conventional hot melt glue gun.
Figure 2:
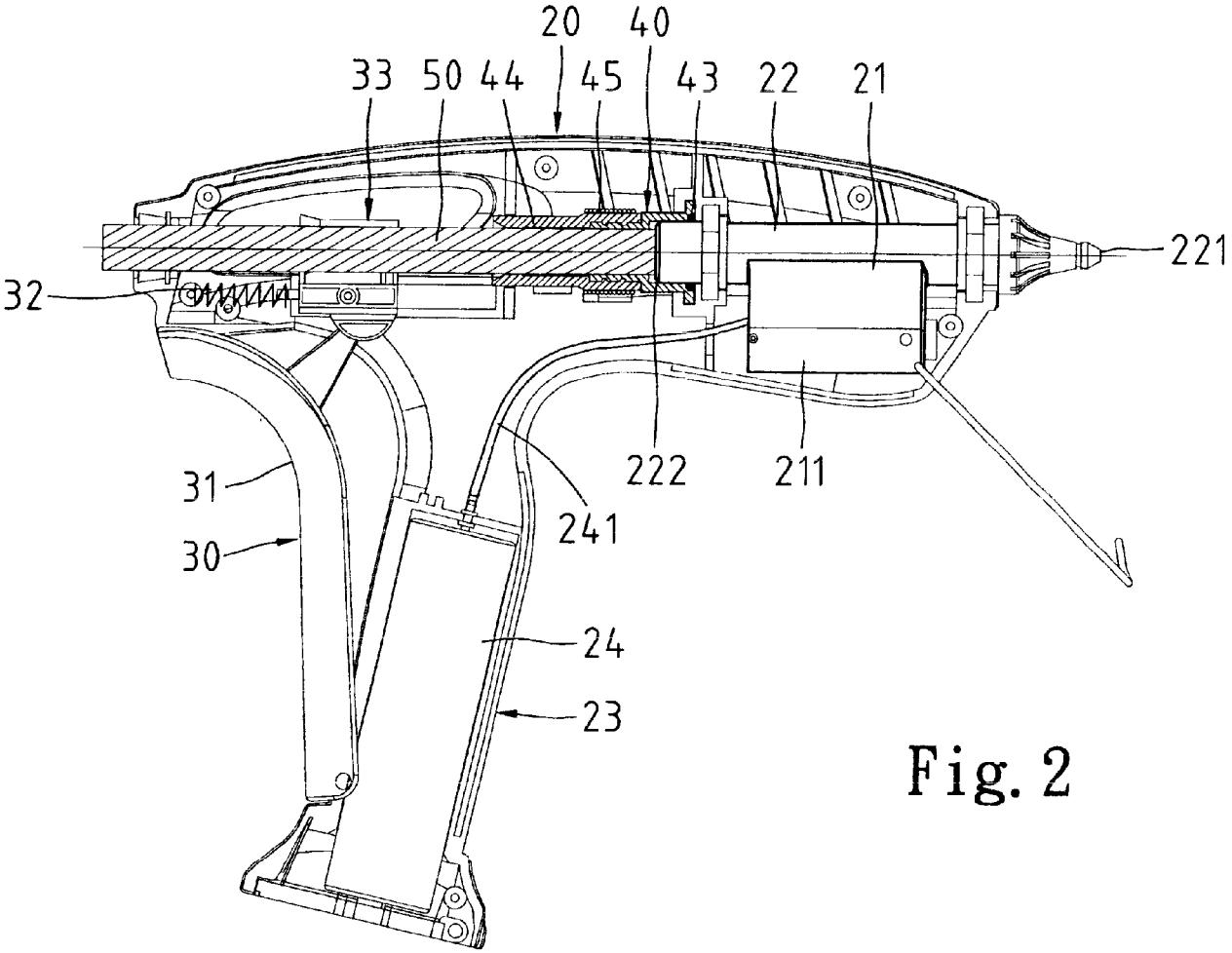
FIG. 2 is a sectional view of a hot melt glue gun in accordance with the present invention.

Referring to FIG. 2, a hot melt glue gun in accordance with the present invention generally comprises a housing 20 having a front portion, a rear portion, and a grip portion 23. A gas container 24 containing flammable gas is mounted in the grip 23. A combustion chamber 21 is provided in the front portion of the housing 20 and in communication with the gas container 24 via a conduit or gas tube 241. An igniting device 211 is provided to ignite the flammable gas fed into the combustion chamber 21. The heat generated in the combustion chamber 21 is transferred to a heating chamber 22 that is also located in the front portion of the housing 20. The outer wall defining the heating chamber 22 is in direct contact with the outer wall defining the combustion chamber 21 to proceed with heat conduction.

A dispensing nozzle 221 is provided to the front end of the housing 20 for dispensing melted glue. A solid glue stick passage is defined in the rear portion of the housing 20 for receiving a solid glue stick 50. A carrier 33 is mounted in the rear portion of the housing 20 and connected to a spring 32 at an end thereof. The carrier 33 comprises a bore (not labeled) that defines a portion of the solid glue stick passage. A trigger 31 is mounted to the housing 20 for actuating the carrier 33 to proceed with feeding of the solid glue stick 50 into the heating chamber 22. The carrier 33 and the trigger 31 together form a feeding mechanism 30 for feeding the solid glue stick 50 into the heating chamber 22. The carrier 33 returns to its initial position when the trigger 31 is released.

Figure 3:
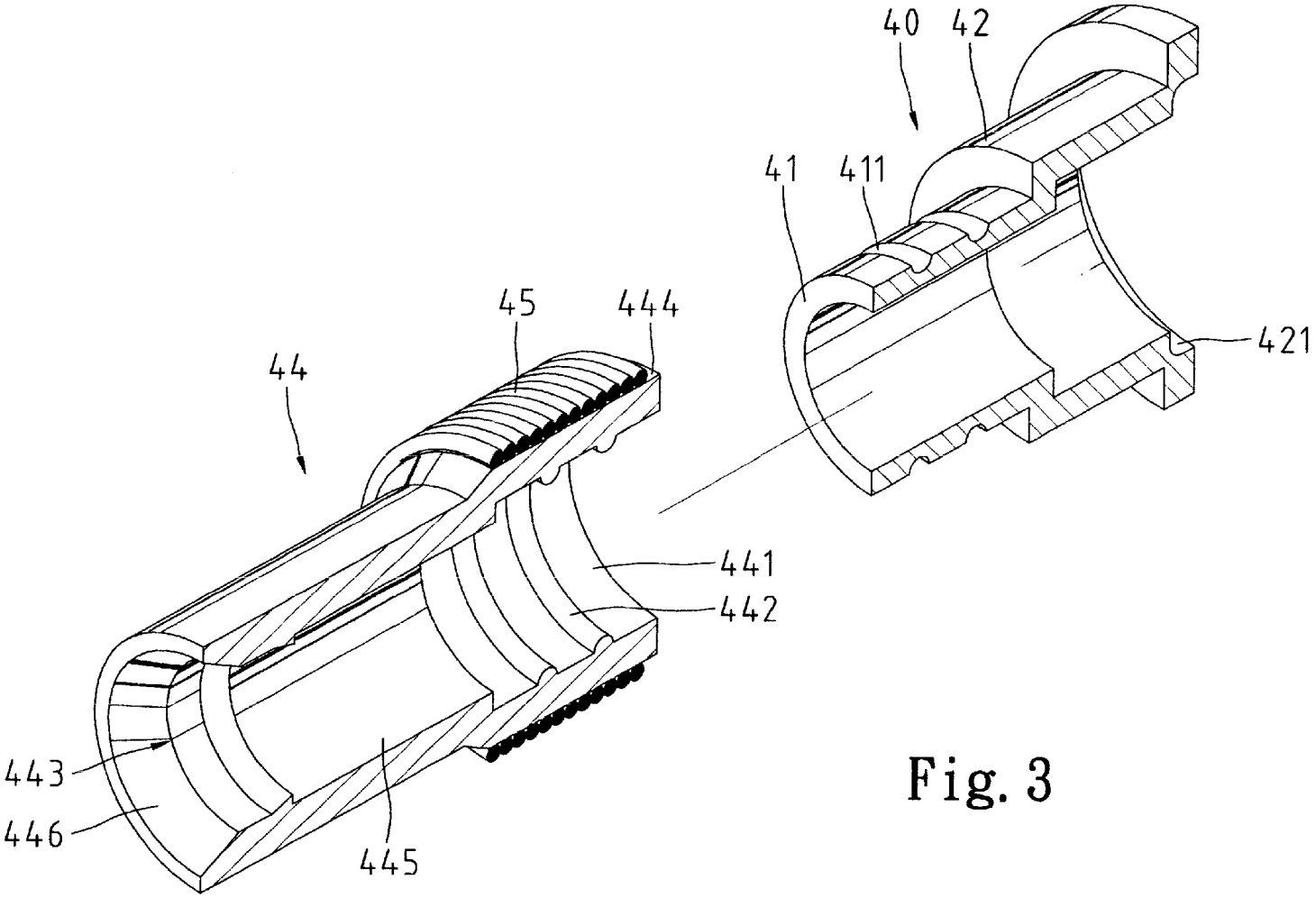
FIG. 3 is an exploded perspective view, partly cutaway, of a sleeve and an insulating member of the hot melt glue gun in accordance with the present invention.

Still referring to FIG. 2 and further to FIG. 3, a sleeve 44 is mounted in an intermediate portion of the housing 20 and located between the heating chamber 22 and the carrier 33 for holding a portion of the solid glue stick 50. The sleeve 44 is made of soft material and comprises a longitudinal bore 445 through which the solid glue stick 50 passes. The sleeve 44 comprises a first end 441 and a second end 443, with the longitudinal bore 445 extending from the first end 441 through the second end 443. In this embodiment, the first end 441 has an inner diameter greater than the remaining portion of the longitudinal bore 445 and comprises at least one annular rib 442 formed on an inner periphery thereof. In this embodiment, there are two annular ribs 442 spaced along a longitudinal direction of the sleeve 44. The second end 443 of the sleeve 44 comprises a conic portion 446.

Of more importance, the hot melt glue gun in accordance with the present invention further comprises an insulating member 40 mounted between the heating chamber 22 and the first end of the sleeve 44. The insulating member 40 is made of temperature-resistant, heat-insulating material for prohibiting heat transfer from the heating chamber 22 to the sleeve 44. In this embodiment, the insulating member 40 is a cylindrical member having a first end 41 engaged in the first end 441 of the sleeve 44 and a second end 42 mounted around an end of an inlet tube 222 that is located outside the heating chamber 22 and communicated with the heating chamber 22. The first end 441 of the insulating member 40 comprises two annular grooves 411 in an outer periphery thereof for securely engaging with the annular ribs 442 of the sleeve 44. The second end 42 of the insulating member 40 comprises an annular groove 421 in an inner periphery thereof for receiving an O-ring 43 (FIG. 2).

As illustrated in FIG. 2, the solid glue stick 50 extends through the carrier 33, the sleeve 44, and the insulating member 40 and enters the heating chamber 22 via the inlet tube 222. When the trigger 31 is pulled, the carrier 33 is actuated to move the solid glue stick 50 into the heating chamber 22. The solid glue stick 50 is heated to its melting point and thus melted in the heating chamber 22. The melted glue is then dispensed via the dispensing nozzle 221. Due to provision of the insulating member 40, the temperature of the sleeve 44 for holding the portion of the solid glue stick 50 outside the heating chamber 22 is kept below the melting point of the solid glue stick 50. This prevents undesired melting (called "abnormal melting") of the solid glue stick 50 outside the heating chamber 22. Blockage of the longitudinal bore 445 of the sleeve 44 resulting from abnormal melting of the solid glue stick 50 outside the heating chamber 22 is thus avoided.

Figure 4:
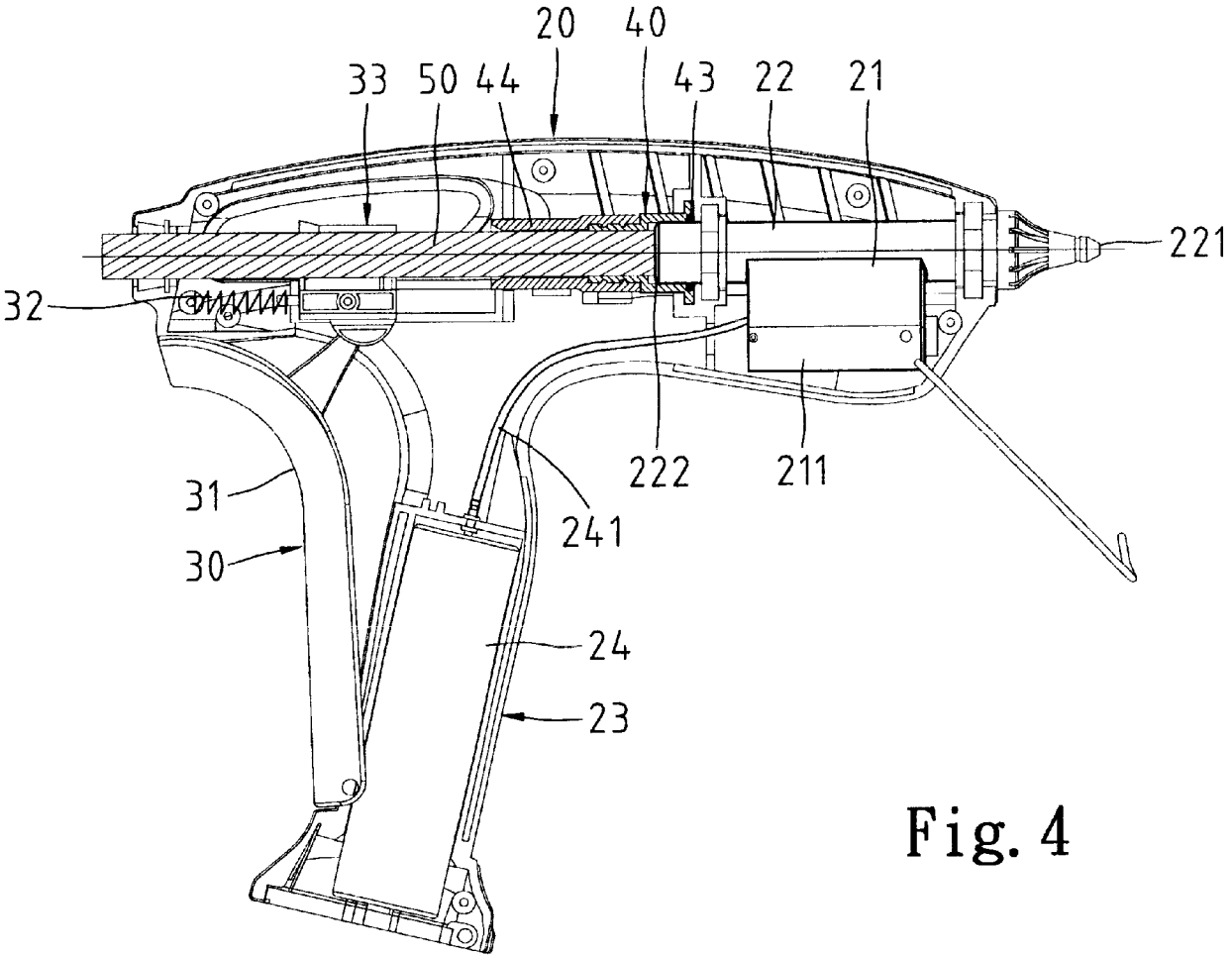
FIG. 4 is a sectional view similar to FIG. 2, illustrating a modified embodiment of the hot melt glue gun.

Referring to FIGS. 2 and 3, a clamp member 45 is mounted around an outer periphery 444 of the first end 441 of the sleeve 44 to provide secure engagement between the first end 441 of the sleeve 44 and the first end 41 of the insulating member 40. Nevertheless, the clamp member 45 can be omitted, as illustrated in FIG. 4 showing an alternate embodiment of the invention.

Figure 5:
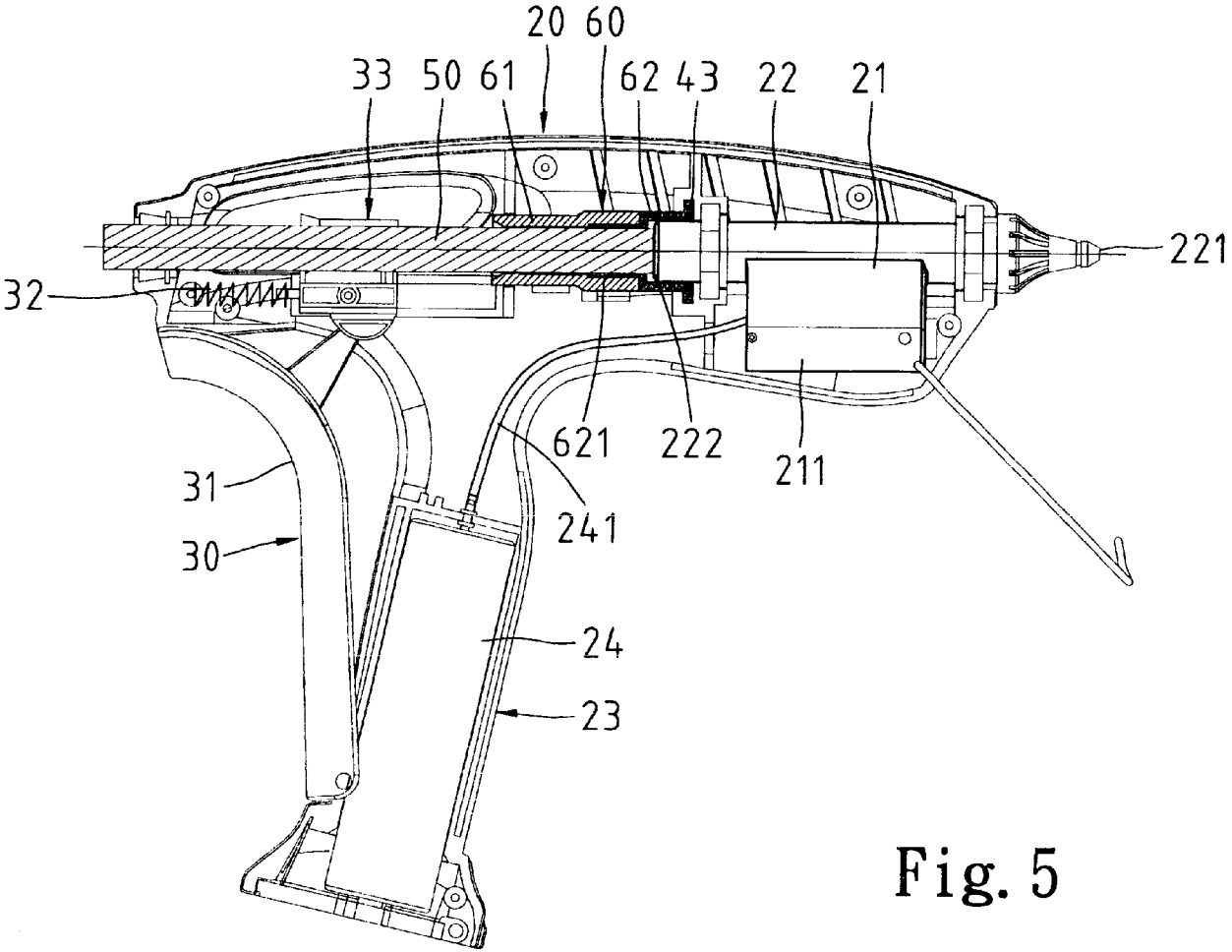
FIG. 5 is a sectional view similar to FIG. 2, illustrating another modified embodiment of the hot melt glue gun.
Figure 6:
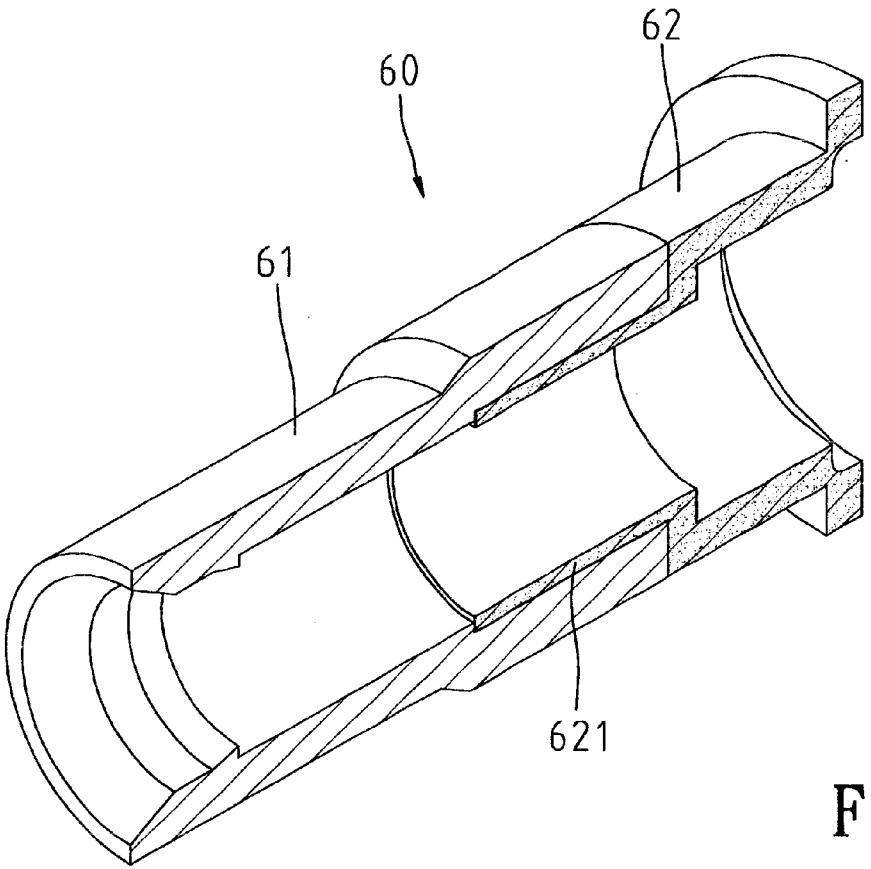
FIG. 6 is a perspective view, partly cutaway, of a sleeve and an insulating member used in the hot melt glue gun in FIG. 5.

FIGS. 5 and 6 illustrate another alternate embodiment of the invention. In this embodiment, the insulating member and the sleeve are integrally formed and designated 60 and include a soft section 61 and an insulating section 62 having a portion 621 extending into an end of the soft section 61; namely, the soft section 61 is similar to the sleeve 44 and the insulating section 62 is similar to the insulating member 40 in the first embodiment.

Figure 7:
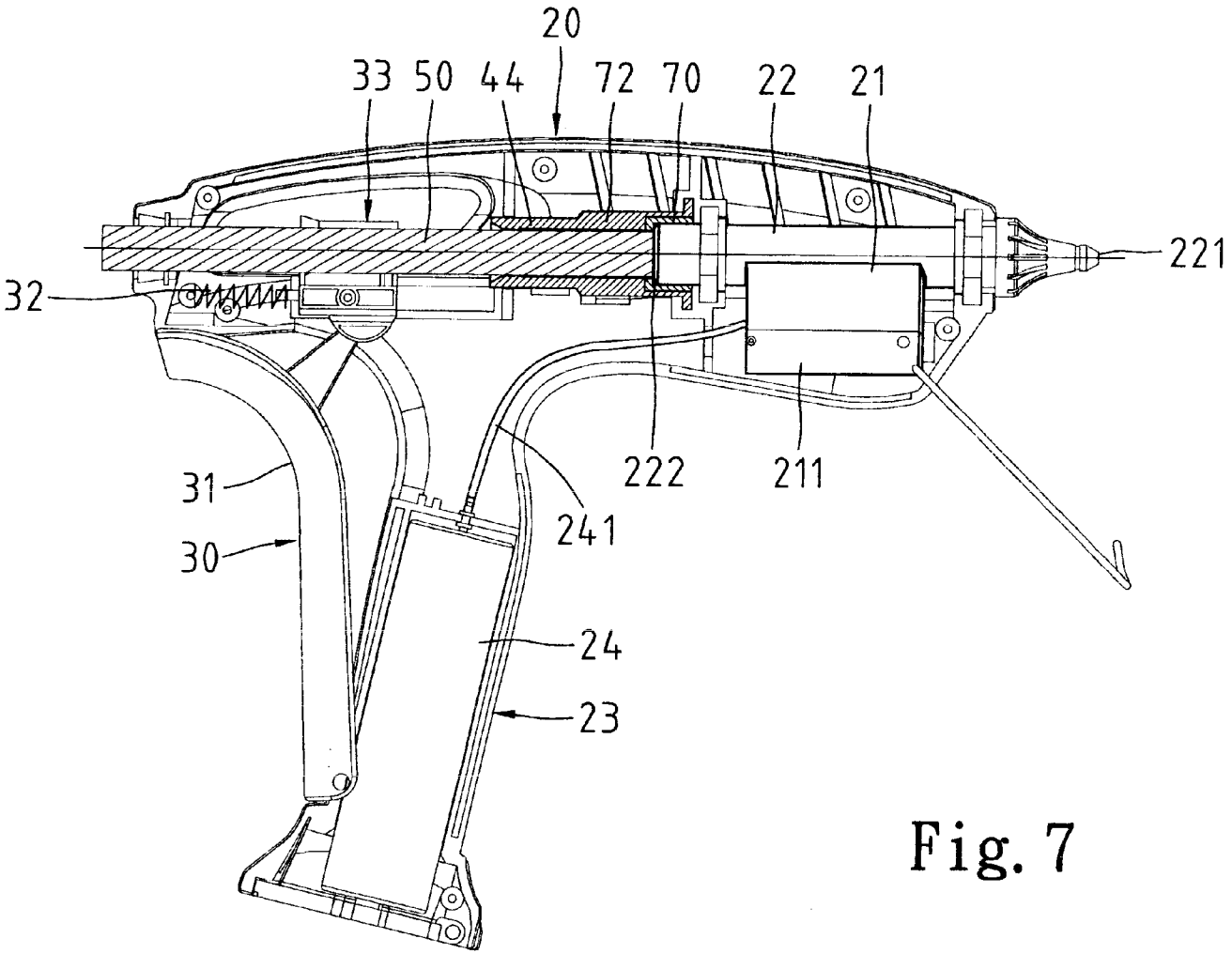
FIG. 7 is a sectional view similar to FIG. 2, illustrating a further modified embodiment of the hot melt glue gun.
Figure 8:
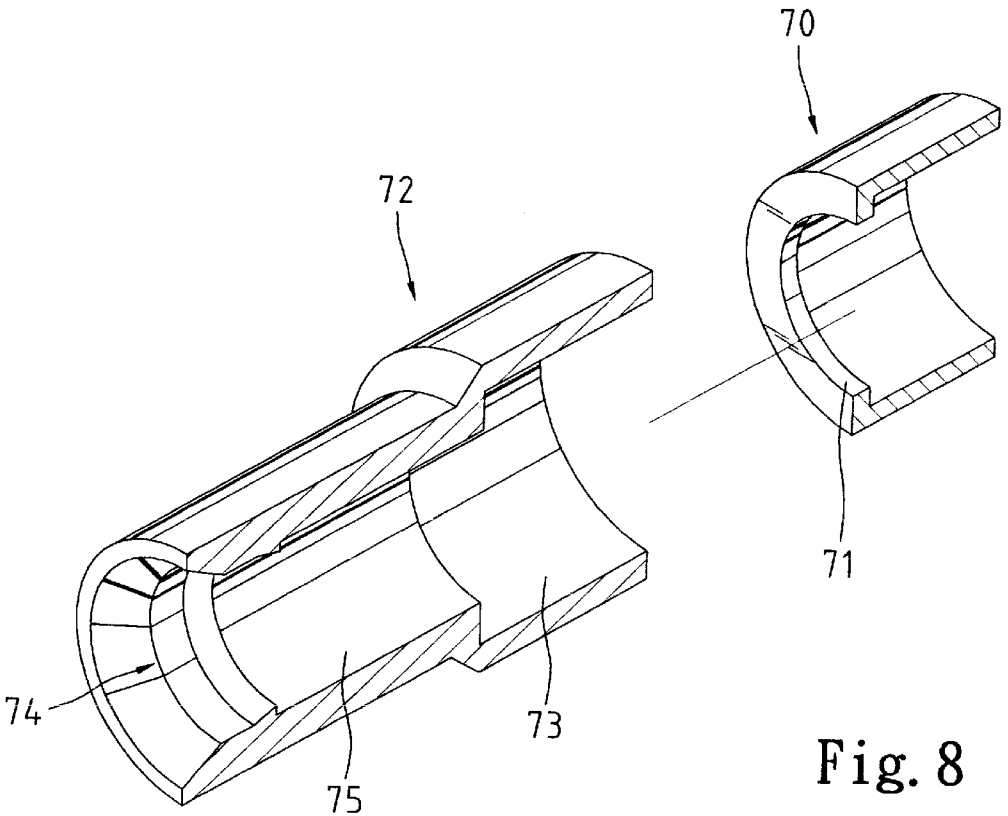
FIG. 8 is a perspective view, partly cutaway, of a sleeve and an insulating member used in the hot melt glue gun in FIG. 7.

FIGS. 7 and 8 illustrate a further modified embodiment of the invention. In this embodiment, the sleeve 72 comprises a first end 73, a second end 74, and a longitudinal bore 75 extending from the first end 73 through the second end 74. The insulating member 70 is mounted in the first end 73 of the sleeve 72. An inner flange 71 is formed in an end of the insulating member 70 and abuts against an end wall of the inlet tube 222 communicated with the heating chamber 22. The heat from the heating chamber 22 cannot be transferred to the sleeve 72 due to the inner flange 71 of the insulating member 70. Due to the provision of the insulating member 70, the temperature of the sleeve 72 for holding the portion of the solid glue stick 50 outside the heating chamber 22 is kept below the melting point of the solid glue stick 50. This prevents undesired melting (called "abnormal melting") of the solid glue stick 50 outside the heating chamber 22. Blockage of the longitudinal bore 75 of the sleeve 72 resulting from abnormal melting of the solid glue stick 50 outside the heating chamber 22 is thus avoided.

Referring to FIGS. 2 and 3, a clamp member 45 is mounted around an outer periphery 444 of the first end 441 of the sleeve 44 to provide secure engagement between the first end 441 of the sleeve 44 and the first end 41 of the insulating member 40. Nevertheless, the clamp member 45 can be omitted, as illustrated in FIG. 4 showing a modified embodiment of the invention.

FIGS. 5 and 6 illustrate another modified embodiment of the invention. In this embodiment, the insulating member 40 and the sleeve (now designated by 61) are integrally formed and include a soft section 61 and an insulating section 62 having a portion 621 extending into an end of the soft section 61; namely, the soft section 61 is similar to the sleeve 44 and the insulating section 62 is similar to the insulating member 40 in the first embodiment.

FIGS. 7 and 8 illustrate a further modified embodiment of the invention. In this embodiment, the sleeve (now designated by 72) comprises a first end 73, a second end 74, and a longitudinal bore 75 extending from a first end 73 through the second end 74. The insulating member (not designated by 70) is mounted in the first end 73 of the sleeve 72. An inner flange 71 is formed in an end of the insulating member 70 and abuts against an end wall of the inlet tube 222 communicated with the heating chamber 22. The heat from the heating chamber 22 cannot be transferred to the sleeve 72 owing to the inner flange 71 of the insulating member 70. Due to provision of the insulating member 70, the temperature of the sleeve 72 for holding the portion of the solid glue stick 50 outside the heating chamber 22 is kept below the melting point of the solid glue stick 50. This prevents undesired melting (called "abnormal melting") of the solid glue stick 50 outside the heating chamber 22. Blockage of the longitudinal bore 75 of the sleeve 72 resulting from abnormal melting of the solid glue stick 50 outside the heating chamber 22 is thus avoided.

Although the invention has been explained in relation to its preferred embodiment, it is to be understood that many other possible modifications and variations can be made without departing from the scope of the invention as hereinafter claimed.

What is claimed is:

1. A hot melt glue gun for receiving a solid glue stick, heating the glue stick to its melting point, and dispensing the melted glue, said hot melt glue gun comprising:

a housing comprising a grip portion and a dispensing nozzle;

a heating chamber defined in the housing for heating a solid glue stick to its melting point;

means for heating the heating chamber;

means for feeding the solid glue stick into the heating chamber;

a sleeve for holding a portion of the solid glue stick outside the heating chamber; and insulating means in the form of a cylindrical member engaged in the sleeve, with the solid glue stick extending through the sleeve and the cylindrical member and entering the heating chamber, with the insulating means prohibiting heat transfer from the heating chamber to the sleeve to keep the sleeve at a temperature below the melting point of the solid glue stick, thereby preventing melting of the portion of the solid glue stick outside the heating chamber.

2. The hot melt glue gun as claimed in claim 1, wherein the grip portion of the housing comprises a gas container mounted therein, the gas container containing flammable gas.

3. The hot melt glue gun as claimed in claim 2, with the heating means comprising a combustion chamber defined in the housing and in communication with the gas container; and means for igniting the flammable gas fed into the combustion chamber.

4. The hot melt glue gun as claimed in claim 3, wherein an outer wall defining the combustion chamber is in direct contact with an outer wall defining the heating chamber, thereby conducting heat from the combustion chamber to the heating chamber.

5. The hot melt glue gun as claimed in claim 1, further comprising an inlet tube outside the heating chamber in communication with the heating chamber for feeding the glue stick into the heating chamber.

6. The hot melt glue gun as claimed in claim 5, wherein the sleeve comprises a first end, a second end, and a longitudinal bore extending from the first end through the second end, the solid glue stick extending through the longitudinal bore, and with the insulating means being an insulating member including a first end engaged in the first end of the sleeve and a second end mounted around the inlet tube.

7. The hot melt glue gun as claimed in claim 6, wherein the first end of the sleeve has an inner diameter larger than a remaining portion of the longitudinal bore.

8. The hot melt glue gun as claimed in claim 6, further comprising a clamp member mounted around the first end of the sleeve for securely retaining the first end of the insulating member in the first end of the sleeve by radially squeezing the first end of the sleeve.

9. The hot melt glue gun as claimed in claim 8, with the clamp member comprising a plurality of coils wrapped around the first end of the sleeve.

10. The hot melt glue gun as claimed in claim 5, wherein the sleeve comprises a longitudinal bore through which the solid glue stick extends, the longitudinal bore having a first end and a second end, the insulating means being an insulating member engaged in the first end of the sleeve and mounted around the inlet tube.

11. The hot melt glue gun as claimed in claim 10, wherein the insulating member comprises an annular flange in an end thereof, the annular flange abutting against an end face of the inlet tube, thereby prohibiting heat transfer from the heating chamber to the sleeve.

12. A hot melt glue gun for receiving a solid glue stick, heating the glue stick to its melting point, and dispensing the melted glue, comprising:

a housing comprising a grip portion and a dispensing nozzle;

a heating chamber defined in the housing for heating a solid glue stick to its melting point;

means for heating the heating chamber;

means for feeding the solid glue stick into the heating chamber;

a sleeve for holding a portion of the solid glue stick outside the heating chamber, with the sleeve defining a first end, a second end and a longitudinal bore extending from the first end through the second end, with the first end of the sleeve having an inner diameter with a larger diameter than a remaining portion of the longitudinal bore;

an insulator member having a first end engaged in the first end of the sleeve, with the solid glue stick extending through the sleeve and the insulator member and entering the heating chamber;

wherein the first end of the longitudinal bore of the sleeve has at least one annular rib formed on an inner periphery thereof, and with the first end of the insulating member comprising at least one annular groove in an outer periphery thereof for engaging said at least one annular rib.

13. The hot melt glue gun as claimed in claim 12, wherein the second end of the longitudinal bore of the sleeve comprises a conic portion.

14. The hot melt glue gun as claimed in claim 12, further comprising an inlet tube outside the heating chamber and communicated with the heating chamber for feeding the glue stick into the heating chamber, with the first end of the insulating member engaged in the first end of the sleeve, with the insulating member including a second end mounted around the inlet tube.

15. A hot melt glue gun for receiving a solid glue stick, heating the glue stick to its melting point, and dispensing the melted glue, comprising:

a housing defining a grip portion and a dispensing nozzle;

a heating chamber defined in the housing for heating a solid glue stick to its melting point;

means for heating the heating chamber;

means for feeding the solid glue stick into the heating chamber;

a sleeve for holding a portion of the solid glue stick outside the heating chamber, with the sleeve comprising a first end, a second end, and a longitudinal bore extending from the first end through the second end, with the solid glue stick extending through the longitudinal bore;

an insulating member interposed between the heating chamber and the sleeve, with the insulating member including a first end, wherein the first end of the sleeve and the first end of the insulating member are integrally formed.

16. The hot melt glue gun as claimed in claim 15, further comprising an inlet tube outside the heating chamber and communicated with the heating chamber for feeding the glue stick into the heating chamber, with the first end of the insulating member engaged in the first end of the sleeve, with the insulating member including a second end mounted around the inlet tube.

* * * * *